US007114717B2

(12) United States Patent
Schuller et al.

(10) Patent No.: US 7,114,717 B2
(45) Date of Patent: Oct. 3, 2006

(54) PRINT MEDIA REGISTRATION DEVICE AND METHOD

(75) Inventors: Peter D. Schuller, Coon Rapids, MN (US); Thomas G. Lindblom, Claremont, MN (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 544 days.

(21) Appl. No.: 10/396,184

(22) Filed: Mar. 24, 2003

(65) Prior Publication Data

US 2004/0188930 A1 Sep. 30, 2004

(51) Int. Cl.
*B65H 29/34* (2006.01)

(52) U.S. Cl. ..... 271/189
(58) Field of Classification Search ..... 271/189
See application file for complete search history.

(56) References Cited

U.S. PATENT DOCUMENTS

| | | | | | |
|---|---|---|---|---|---|
| 4,844,440 | A | | 7/1989 | Gray | |
| 4,844,633 | A | * | 7/1989 | Greenberg | 400/625 |
| 5,415,390 | A | * | 5/1995 | Guerrero | 271/215 |
| 6,116,594 | A | | 9/2000 | Boost | |
| 6,702,278 | B1 | * | 3/2004 | Michel | 271/220 |

FOREIGN PATENT DOCUMENTS

EP 0 939 048 A2 * 9/1999

* cited by examiner

*Primary Examiner*—Donald P. Walsh
*Assistant Examiner*—Kenneth W. Bower

(57) ABSTRACT

The invention is directed to a print media registration device. More particularly, and by way of example and not limitation, the invention is directed to a printed media registration arm that sweeps an arc while carrying a document output to a tray or other receptacle to move the document into the corner of the receptacle.

7 Claims, 8 Drawing Sheets

PRINT MEDIA REGISTRATION DEVICE AND METHOD

FIELD OF THE INVENTION

The invention is directed to a print media registration device. More particularly, and by way of example and not limitation, the invention is directed to a print media registration arm that sweeps an arc while carrying a document output to a tray or other receptacle to move the document into the corner of the receptacle.

BACKGROUND

The position of each sheet or bound document output by printers and post print finishing devices often varies according to the output tolerances of the particular device. Where multiple documents are output into a stack in the output tray, the edges of the documents are seldom aligned with one another. It is often desirable and sometimes necessary to align the documents in the output stack. One common alignment technique moves each document in one direction until one edge abuts a mechanical stop in the output tray, typically the side of the tray. A similar alignment technique moves each document in two directions until two edges abut a mechanical stop, typically the back and side of the output tray. These techniques for edge alignment are commonly referred to as registration, or registering the document. The technique for two edge alignment is commonly referred to as corner registration because each document is moved toward the corner of the tray. The present invention was developed in an effort to improve on conventional techniques for corner registering documents output by printers and post print finishing devices.

DETAILED DESCRIPTION

Figure 1:
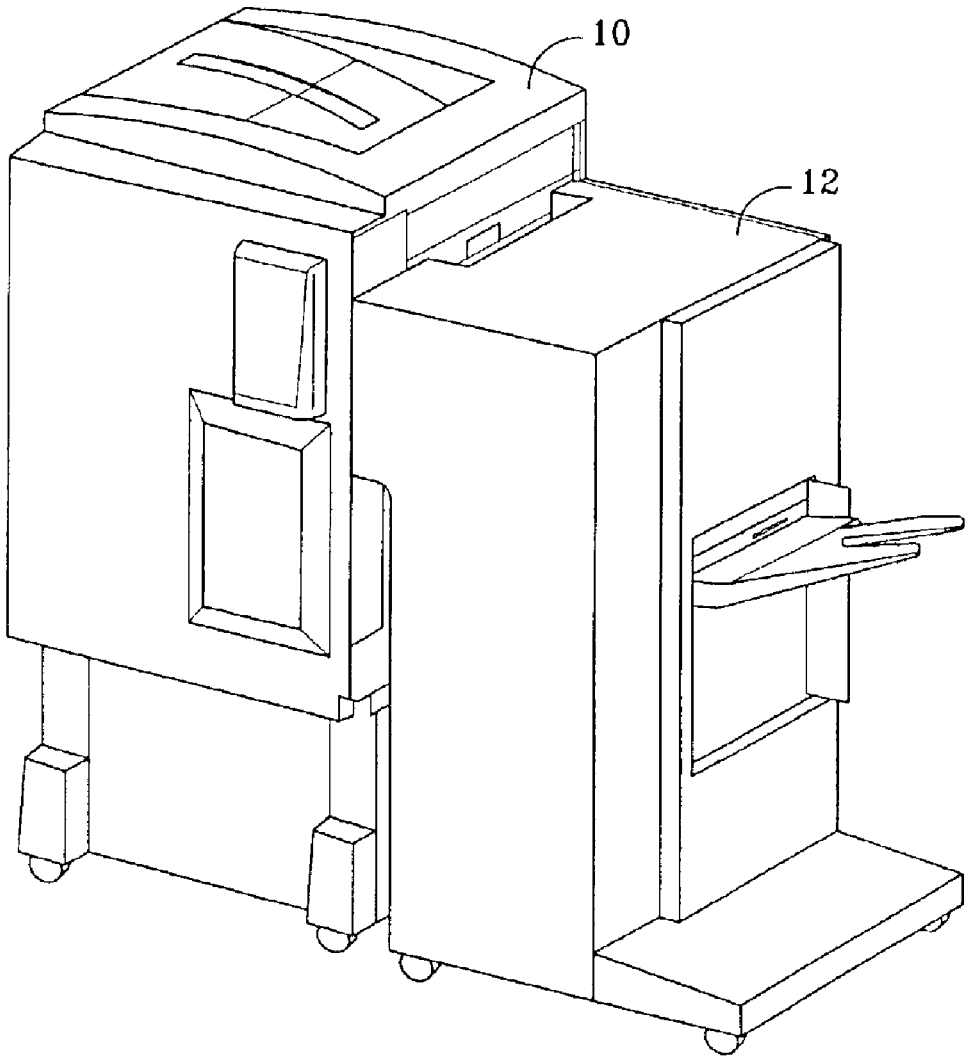
FIG. 1 is a perspective front side view illustrating a printer with an attached post print finishing device.
Figure 2:
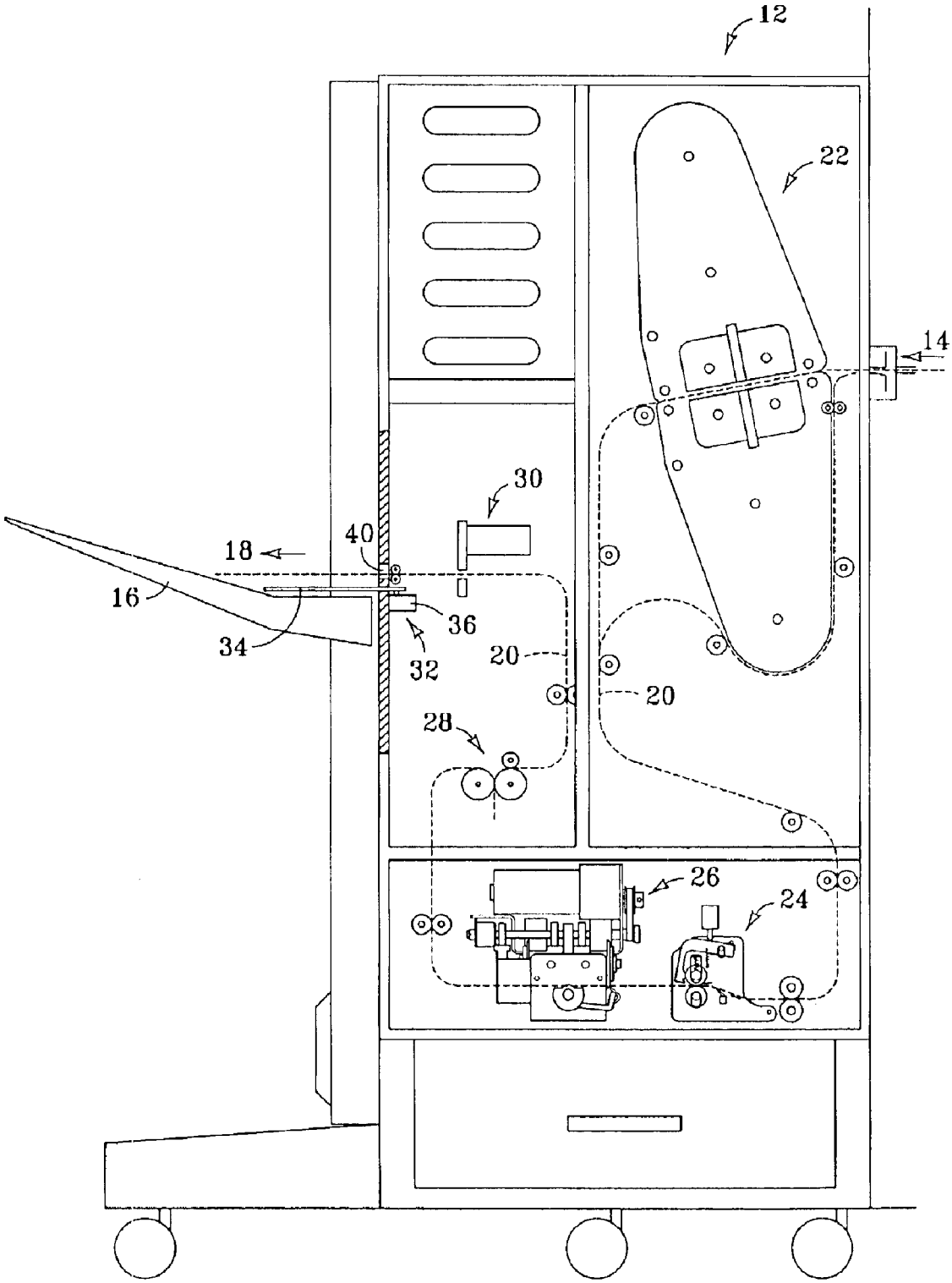
FIG. 2 is an elevation side view illustrating the major components and media path through a post print finishing device such as the one shown in FIG. 1.

FIG. 1 illustrates a printer 10 with an attached post print finishing device 12. FIG. 2 illustrates the major components and media path through a post print finishing device such as the one shown in FIG. 1. FIGS. 1–2 illustrate one exemplary environment in which various embodiments of the invention may be implemented. The finishing device of FIG. 2 includes sheet coating, trimming and stapling, and booklet making capabilities. While it is believed that embodiments of the registration device of the present invention will be particularly useful to register booklets and other multi-page documents, such as might be output by finishing device 12, embodiments of the invention may be used with any printer or print media output device in which side or corner registration is desired. Printer is used broadly in this document to mean any printing device including, for example, laser printers, inkjet printers, copiers and multi-function devices.

Referring to FIG. 2, printed media sheets are output to finishing device 12 as noted by arrow 14, and discharged from finishing device 12 to output tray 16 as noted by arrow 18. The media path through finishing device 12 is indicated by broken line 20 in FIG. 2. Media sheets output to finishing device 12 are transported through or around coating unit 22 to a pre-trim registration unit 24, trimming unit 26, folding unit 28 and stapling unit 30 before they are discharged to output tray 16 and output registration device 32.

Coating unit 22 coats printed media with a film of clear flexible material. Such coatings can be formulated and applied to help protect the printed image, enhance the printed image or provide a more uniform gloss level across the entire media (including both printed and unprinted areas). If a coating is not desired, then media sheets are moved along a bypass path around coating unit 22. Pre-trim registration unit 24 registers each sheet to trimming unit 26 before it enters trimmer 26. That is to say, registration unit 24 straightens or "deskews" each sheet as necessary to ensure the sheet is properly aligned in the media path as it enters trimmer 26. Trimming unit 26 trims the leading edge of each sheet or the trailing edge of each sheet, or both, as necessary to make the sheet the desired size for the finished booklet or other document. Folding unit 28 folds each sheet by creasing the sheet along the desired fold line. Stapling unit 30 staples each booklet after the sheets are trimmed, folded and assembled.

FIGS. 3–8 illustrate a print media output registration device 32 constructed according to one embodiment of the invention. Referring to FIGS. 3–8, registration device 32 includes a registration arm 34 operatively coupled to a reversing motor 36 through any suitable drive train 38. (Motor 36 and drive train 38 are omitted from FIGS. 4–8 for clarity.) Drive train 38, for example, may include a shaft or belt and the appropriate reduction gears connected to a motor 36 dedicated solely to operation of registration arm 34. Alternatively, drive train 38 may include gears, belts and other linkage connecting arm 34 to a remote motor that typically is also used to drive other components of finishing device 12.

Figure 3:
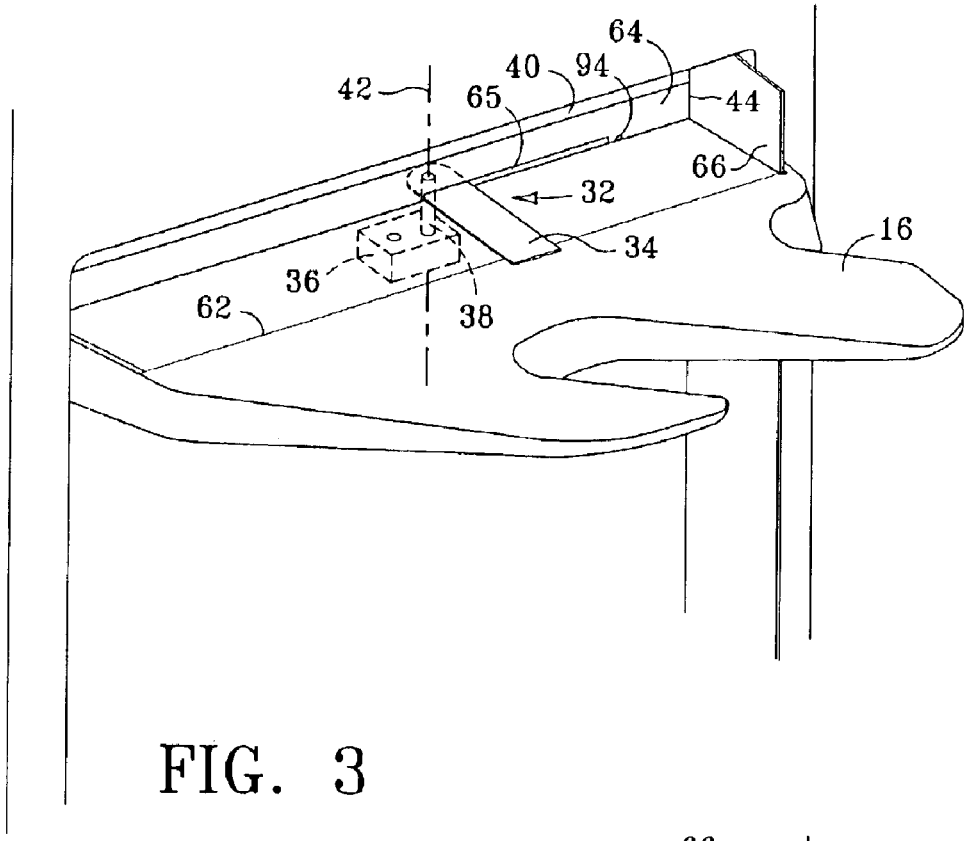
FIGS. 3–8 are perspective views showing the structure and sequence of operation of a print media registration device according to one embodiment of the invention.
Figure 4:
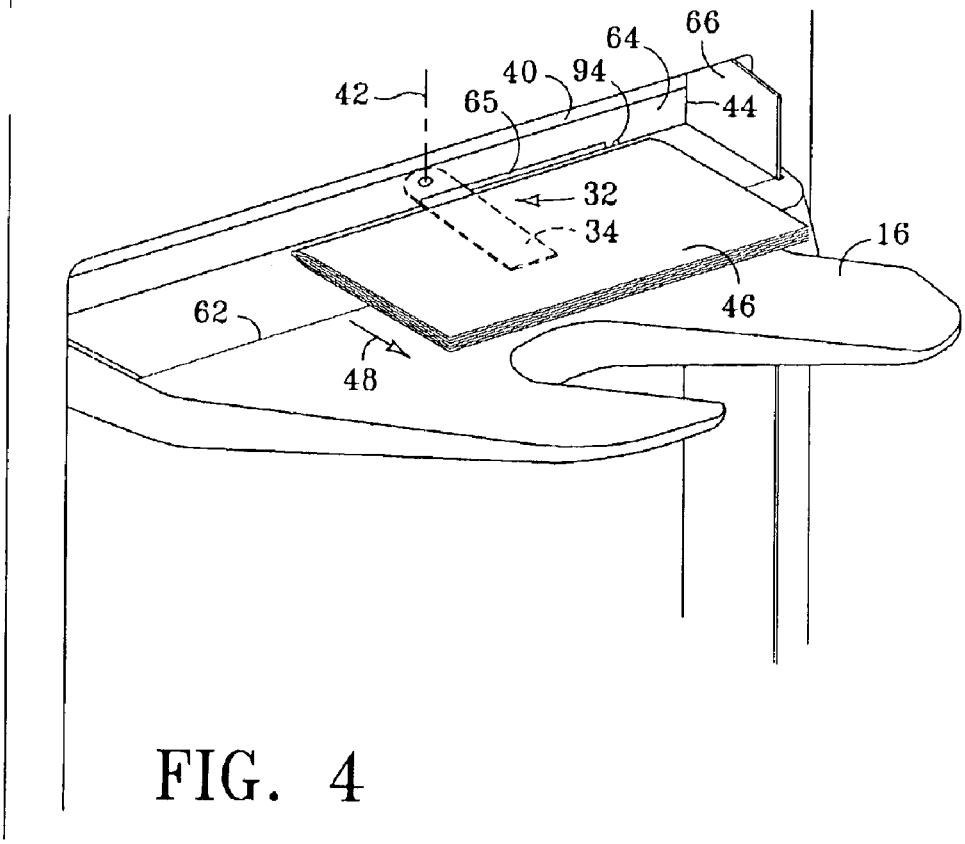
Figure 5:
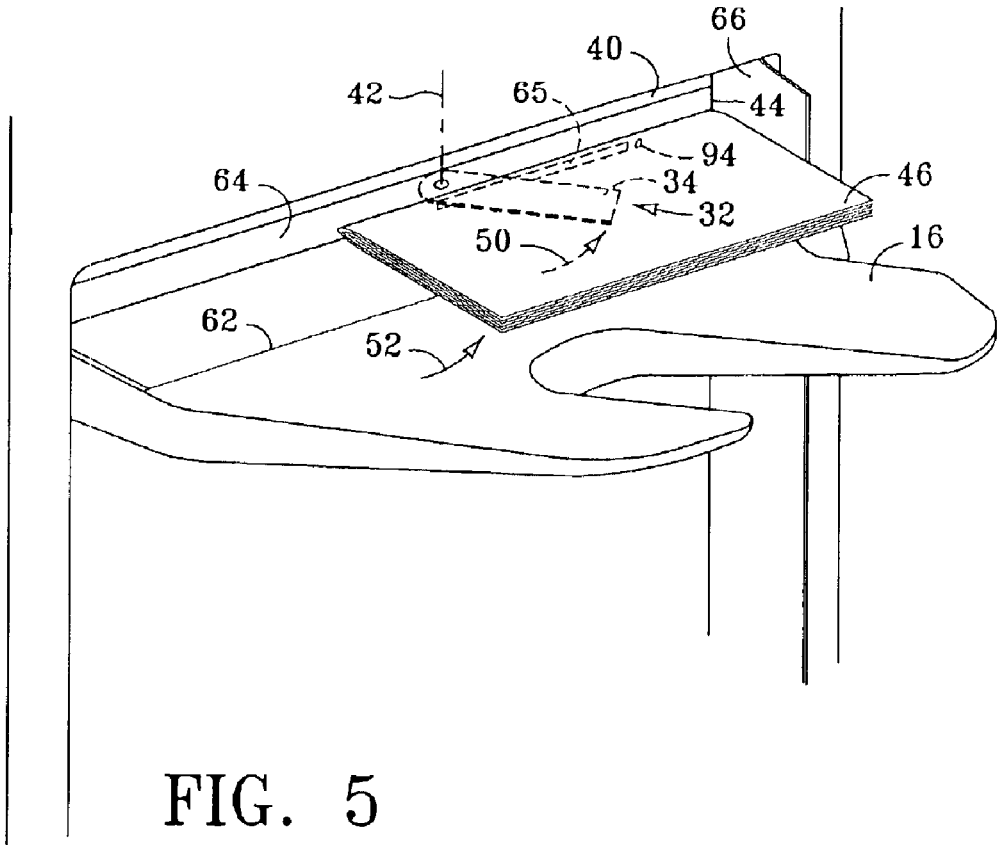
Figure 6:
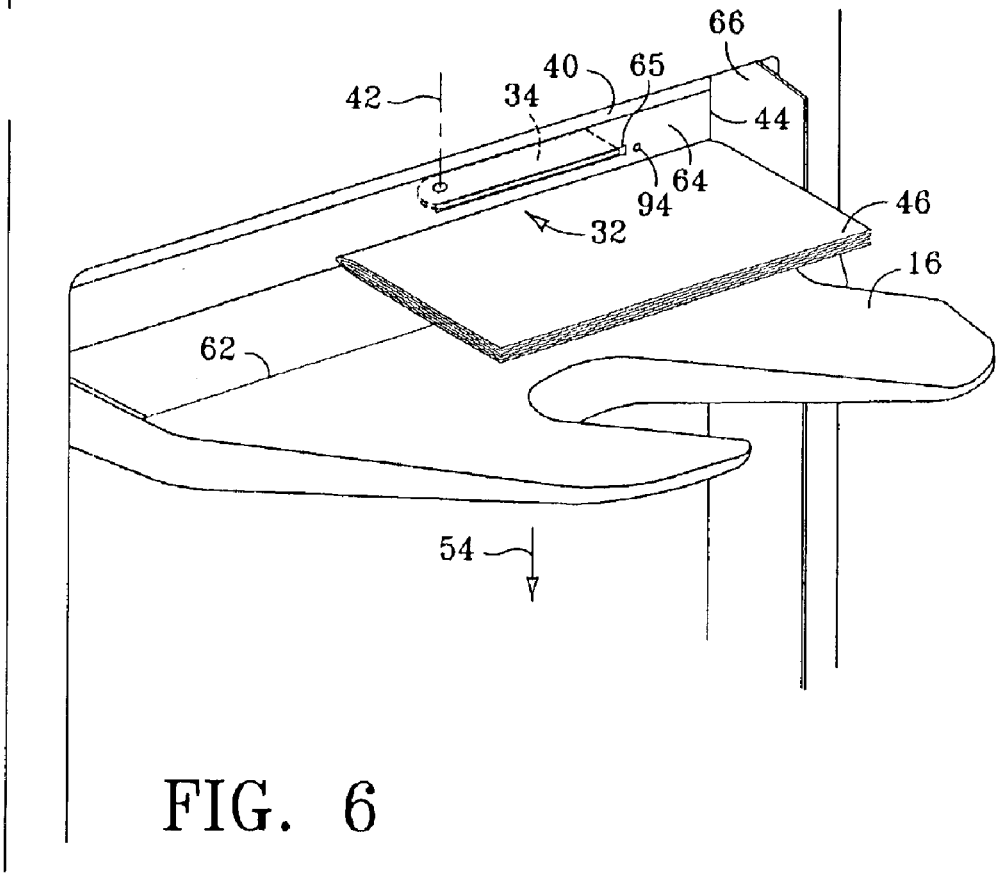

Registration arm 34 is positioned above output tray 16 and below print media output port 40. Registration arm 34 pivots on an axis 42 at the urging of motor 36 to sweep an arc between a first extended position, in which arm 34 extends over output tray 16, toward a corner 44 of tray 16 to a second retracted position, in which arm 34 does not extend out over tray 16. FIG. 3 shows registration arm 16 in the extended position over tray 16. In FIG. 4, a booklet 46 is output through port 40 into tray 16 on top of arm 34 as indicated by direction arrow 48. In this position, booklet 46 rests on arm 34 and the bottom surface of booklet 40 contacts the top surface of registration arm 34. Referring to FIG. 5, as registration arm 34 pivots, it drags booklet 46 toward corner 44 under the influence of the frictional forces between booklet 46 and arm 34, as indicated by direction arrows 50 and 52. As shown in FIG. 6, booklet 46 stops at corner 44 while registration arm 34 sweeps on through to the retracted position.

The frictional forces between registration arm 34 and booklet 46 or other document output to tray 16 vary proportionally with the weight of the document. Hence, registration device 32 is self-regulating in the sense that the weight of the document helps regulate the force applied to move the document toward corner 44—heavier documents help generate the greater forces needed to move the document while lighter documents generate smaller forces. Complicated or expensive force regulating systems are not needed. In addition, registration arm 34 reduces friction between documents. Arm 34 separates the output document from the stack to help prevent sticking, even with coated documents. Conventional top registration rollers, by contrast, introduce more friction between the output document and other documents in the stack, increasing the force needed to side or corner register the output document.

In order to place a substantial amount of the weight of booklet 46 over registration arm 34, arm 34 should reach at least ⅓ of the distance to the center of the largest booklet 46 or other document that may be output to registration device 32. At a minimum, the arc swept by registration arm 34 must be long enough to allow arm 34 to move booklet 46 fully into corner 44.

In the retracted position shown in FIG. 6, arm 34 is tucked into a slot 65 at the rear of tray 16, or is otherwise positioned clear of booklet 46 so that booklet 46 falls freely into tray 16. Depending on the size and number of booklets 46 or other documents output to tray 16, it may be necessary to index output tray 16 down to provide clearance for the next document to slide into tray 16, as indicated by direction arrow 54 in FIG. 6. For example, if several large booklets will be stacked in tray 16, then it will be necessary to index tray 16 down after each booklet is output to the tray. If several small booklets will be stacked in tray 16, then it may be necessary to index tray 16 down only after two or three booklets are output to the tray. If, however, only a few single sheets or small booklets will be stacked in tray 16, then it may not be necessary to index tray 16 down at all.

Figure 7:
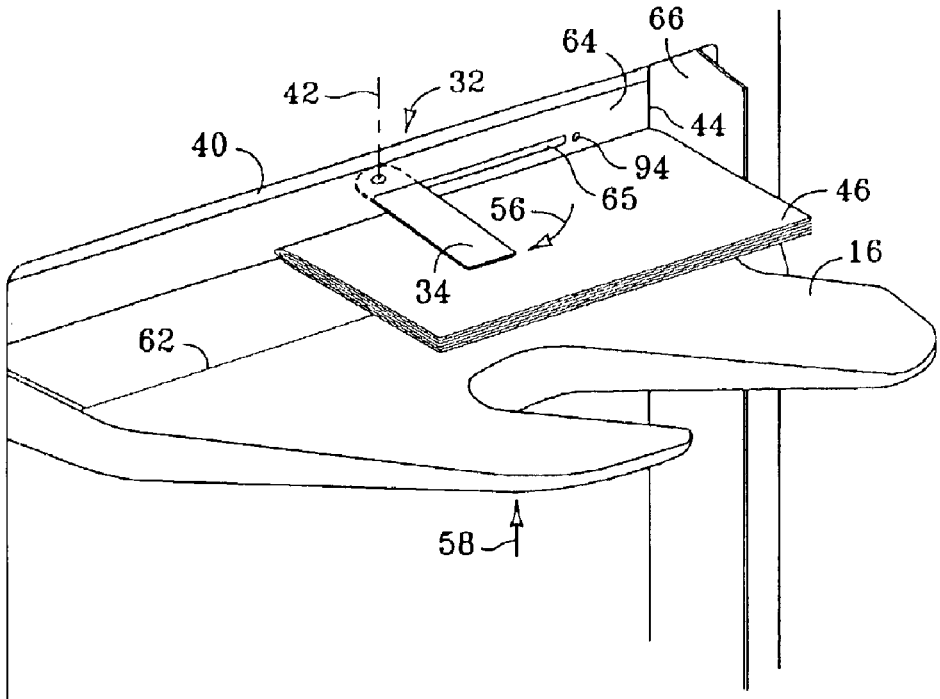
Figure 8:
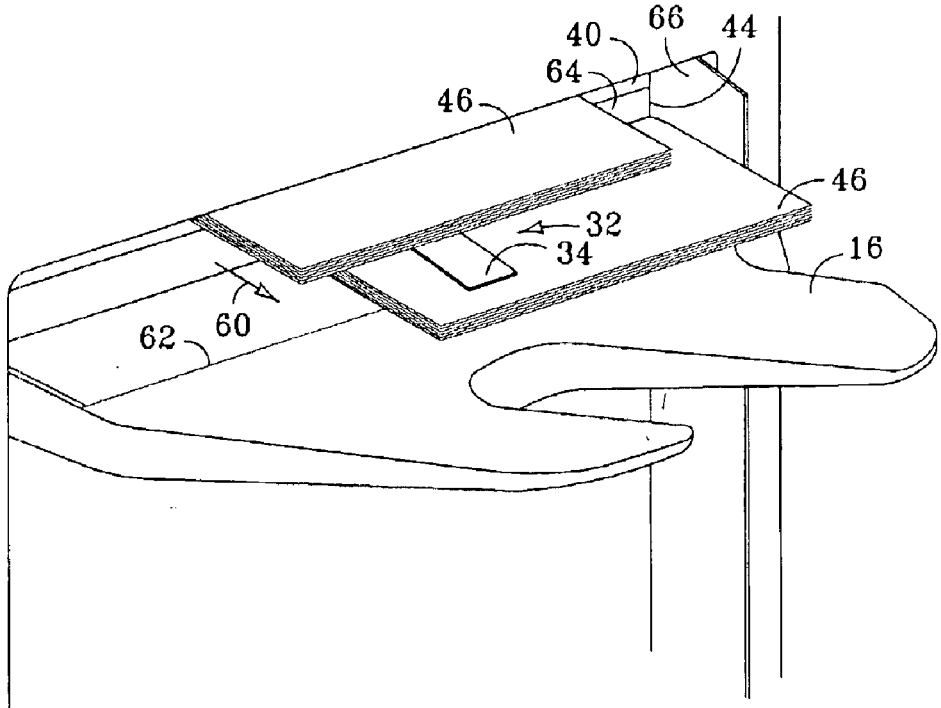

Once booklet 46 has dropped down clear of registration arm 34, and tray 16 has been indexed down if necessary, registration arm 34 pivots back to the first/extended position at the urging of reversing motor 36, as indicated by direction arrow 56 in FIG. 7. It may be desirable at this point to index output tray 16 up, as indicated by direction arrow 58 in FIG. 7, to compress the stack between tray 16 and registration arm 34. This compression reduces pillowing of stacked booklets. In any event, arm 34 is in position again to receive the next booklet 46, as shown in FIG. 8, where direction arrow 60 indicates another booklet 46 being output to tray 16.

Figure 9:
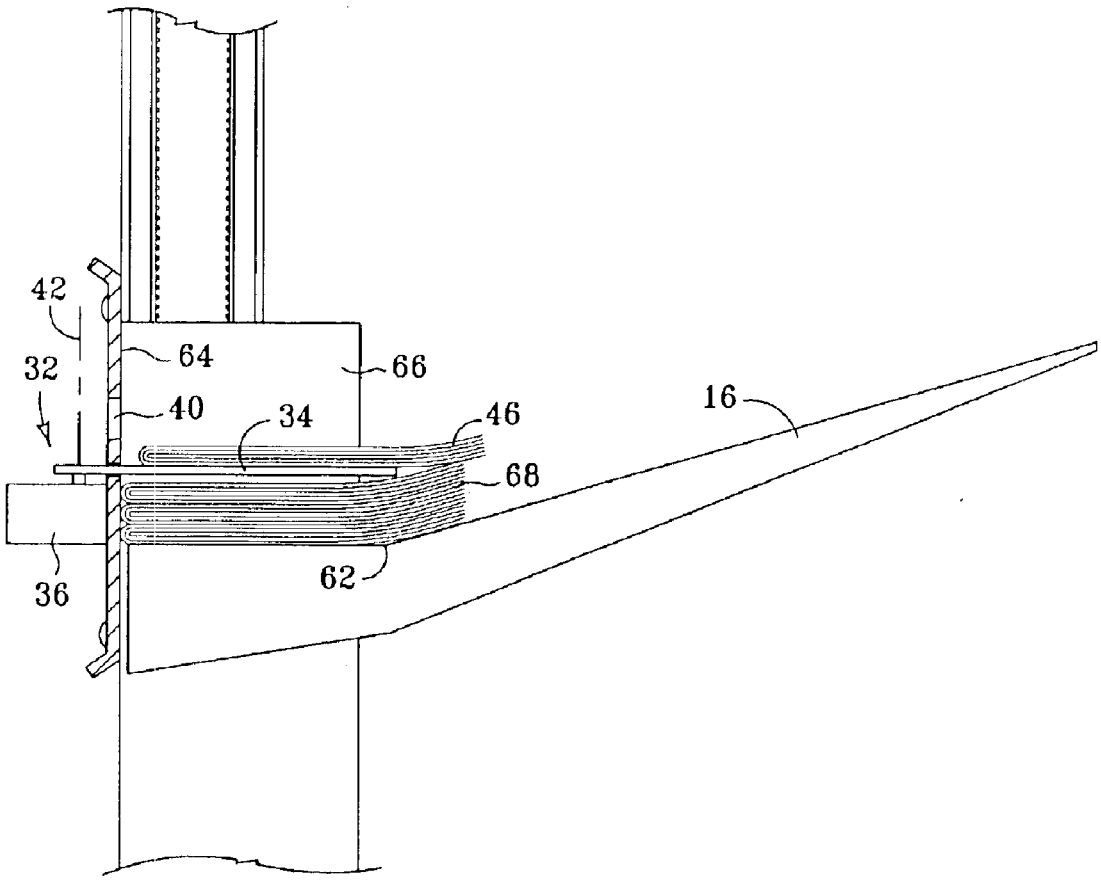
FIG. 9 is an elevation side view of a print media registration device such as the one shown in FIGS. 3–8.

Referring now also to FIG. 9, in the embodiment shown in the figures, output tray 16 turns up slightly at bend 62 to urge booklets 46 toward a back stop 64. This configuration for tray 16, which is typical of many conventional print media output trays, helps position booklets 46, single sheets or other multiple page documents against back stop 64. Back stop 64 and side stop 66 intersect to form corner 44. Registration arm 34 pivots into slot 65 in back stop 64 clear of booklet 46 and tray 16. (Corner 44 and slot 65 can be seen in FIGS. 3–7.) Back stop 64 may be constructed as an integral part of tray 16 or, as best seen in FIG. 9, a discrete structural component positioned at the rear of tray 16. Similarly, side stop 66 may be constructed as an integral part of tray 16 or, as shown in the figures, a discrete structural component positioned along the side of tray 16. In this configuration, a stiff registration arm 34 extends a short distance past bend 62 in tray 16 so that only the end of arm 34 contacts stack 68. In this configuration, there is minimal friction or "drag" as arm 34 sweeps across the top of stack 68. While this configuration is expected to work well in many typical printed media output applications, the length and flexibility of registration arm 34 may be varied as necessary or desirable to accommodate different operating environments and applications.

Other factors may also be used to influence performance. The width and surface texture of registration arm 34, for example, may be selected in connection with the length and flexibility of arm 34 to optimize performance. It may be desirable for some applications to form a shorter registration arm 34 with a high friction top surface. Alternatively, a smooth but flexible arm 34 may be better suited to a particular application.

Figure 10:
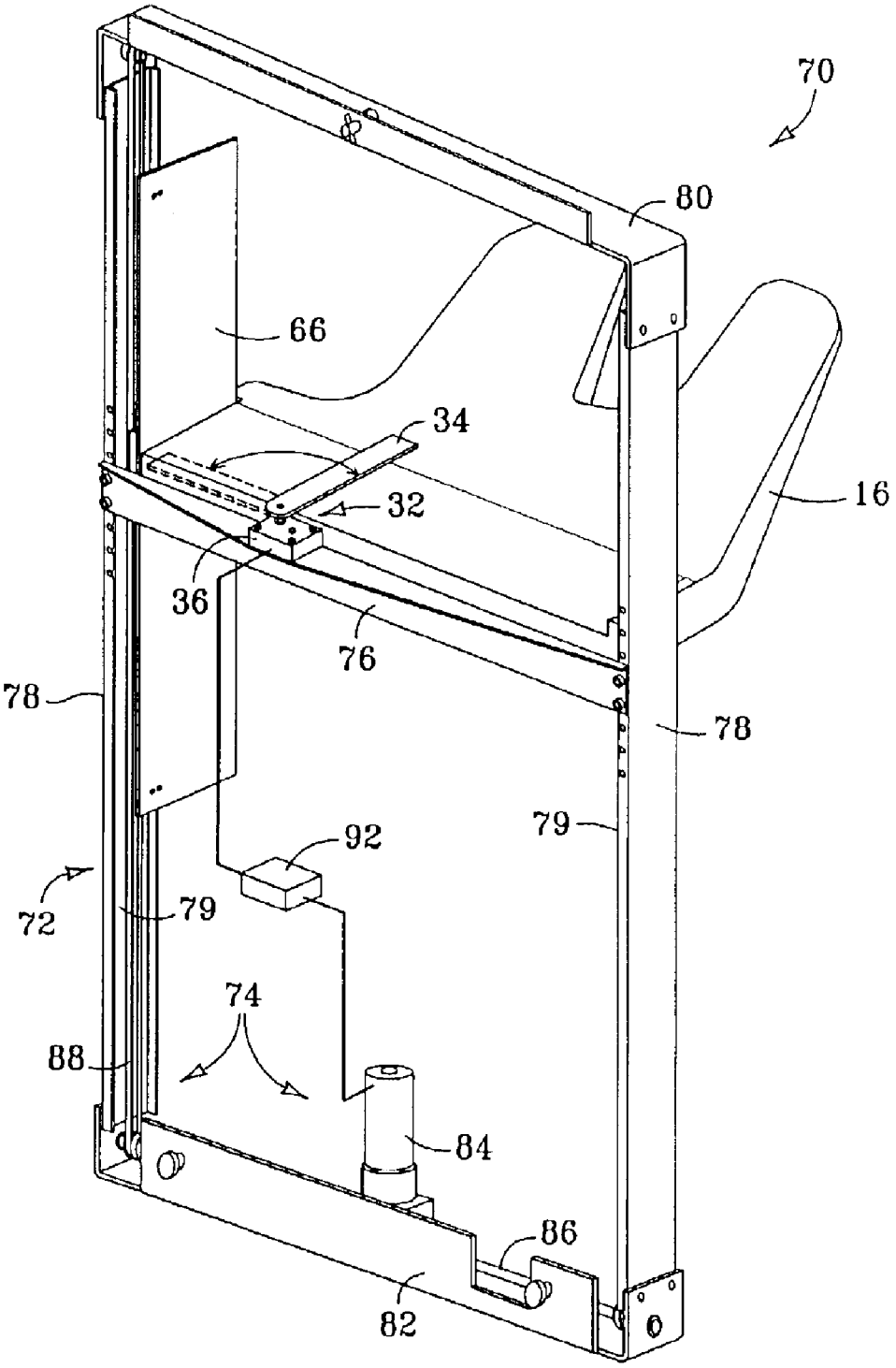
FIG. 10 is a perspective rear side view of an output device that incorporates the print media registration device of FIG. 9.
Figure 11:
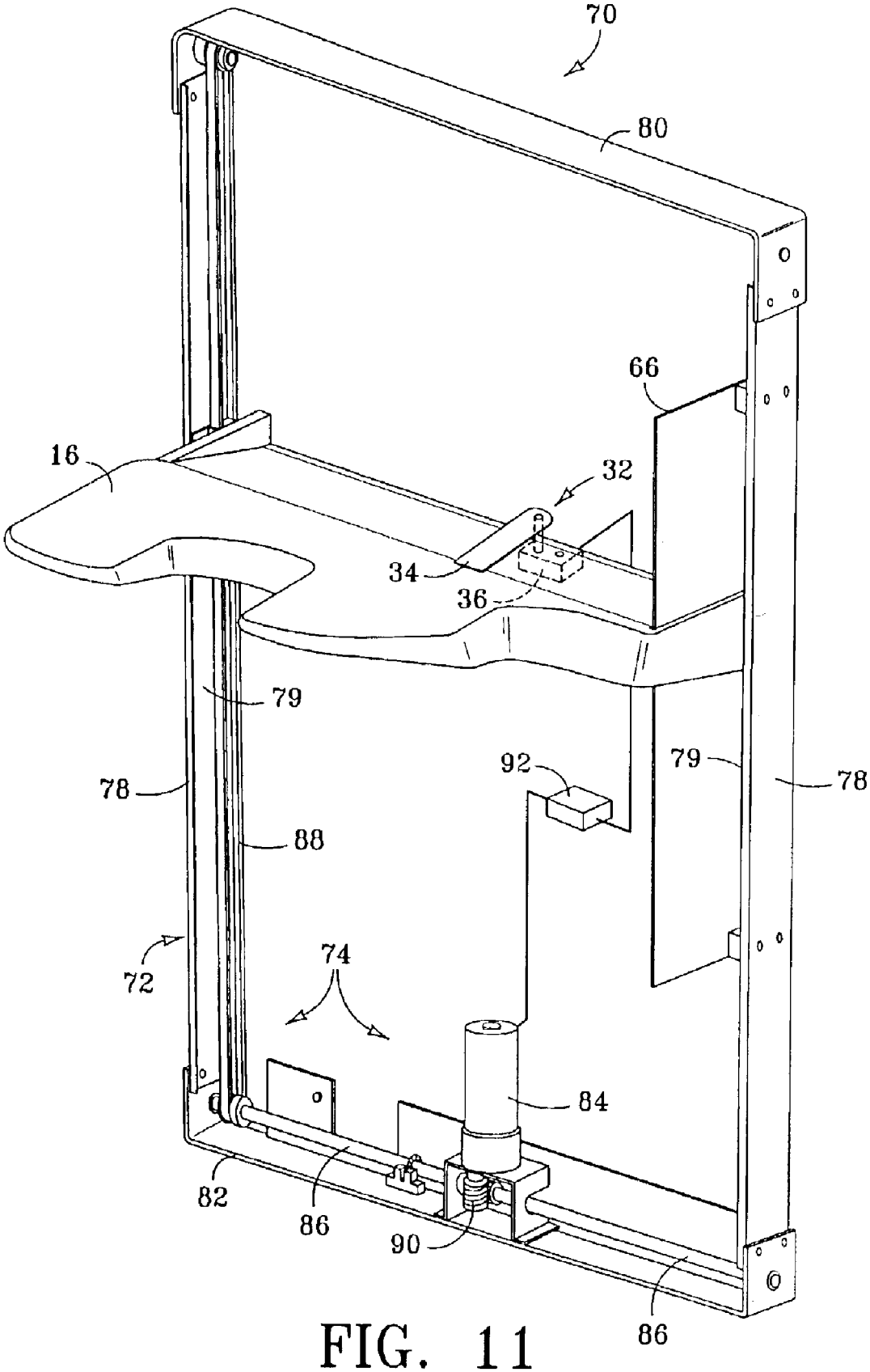
FIG. 11 is a perspective front side view of the output device of FIG. 10.

FIGS. 10 and 11 are perspective rear and front views, respectively, of an output device 70 that incorporates a registration device 32 such as the one shown in FIGS. 3–9. Referring to FIGS. 10 and 11, output device 70 includes output tray 16, registration device 32, frame 72 and a tray drive system 74. Registration devIce 32 is mounted to a frame cross member 76 that extends between frame side members 78. Frame top member 80 and frame bottom member 82 extend between side members 78. Tray drive system 74 includes a reversing motor 84, drive shafts 86 and endless loop belts 88. Tray 16 is mounted between and moves along a pair of slide rails 79 attached to or integral with frame side members 78 at the urging of motor 84. Belts 88 are operatively connected to reversing motor 84 through shafts 86 and gears 90. Motor 86 is mounted to frame bottom member 82. Each side of tray 16 is connected to one run of each belt 88 so that belts 88 carry tray 16 along rails 79 as motor 58 drives belts 88 up and down together. The outboard ends of drive shafts 86 are supported on bearings or bushings (not shown) in frame bottom member 82. Frame 72 and tray drive system 74 are described in more detail in commonly assigned U.S. patent application Ser. No. 10/396,276 filed Mar. 24, 2003 and entitled Print Media Output Receptacle Rail Support And Drive System, incorporated herein by reference in its entirety.

A programmable controller 92 electrically coupled to motors 36 and 84 controls the operation of output device 70. Although it is expected that controller 92 will be implemented as part of the controller for finishing device 12 shown in FIGS. 1 and 2, controller 92 could also be implemented as a discrete output device controller or as part of the printer controller for systems in which the printer controller controls print and post print operations or in systems in which the printer outputs directly to tray 16. As with conventional printer and finishing device controllers, controller 92 will typically include a processor and associated memory. Random access memory (RAM) or other suitable operational memory contains job data from the attached printer or host computer along with programming and other data currently being executed or used by the processor. Read only memory (ROM) or other suitable operational/storage memory contains the device firmware that provides programming instructions to control the operation of finishing device 12 and output device 70.

Controller 92 executes firmware programming instructions according to command inputs from the attached printer or host computer and in response to input from sensors and other components of finishing device 12 and output device 70. Some embodiments of the invention, therefore, may be implemented through a computer readable medium with instructions that, when executed by controller 92 and/or another computer, control the operation of printer 10, finishing device 12 and/or output device 70. As used in this document, computer readable medium means any medium that can contain, store or propagate computer readable instructions.

In operation, registration arm 34 rests in the extended position awaiting document output as shown in FIG. 3. Referring to FIG. 4, when a booklet 46 or other document is output to tray 16, controller 92 energizes registration motor 36 to sweep registration arm 34 counter-clockwise to register booklet 46 into corner 44, as shown in FIG. 5. Once arm 34 clears booklet 46, as shown in FIG. 6, controller 92 energizes tray drive motor 84 to index tray 16 down a predetermined distance, or until position sensor 94 signals controller 92 that booklet 46 has dropped below the sensor. Controller 92 then energizes registration motor 36 to return registration arm 34 to the extended position, as shown in FIG. 7. For booklet compression, controller 92 energizes tray drive motor 84 to index tray 16 back up a predetermined distance, or until booklet 46 has moved up to position sensor 94, to press booklet 46 against registration arm 34, as indicated by arrow 58 in FIG. 7. Registration device 32 is then ready to receive the next booklet 46, as shown in FIG. 8.

The exemplary embodiments shown in the figures and described above illustrate but do not limit the invention. Other forms, details, and embodiments may be made and implemented. Hence, the foregoing description should not be construed to limit the spirit and scope of the invention, which is defined in the following claims.

What is claimed is:

1. A print media output device, comprising:

an output receptacle; and a movable arm disposed adjacent to the receptacle, the arm pivotable to sweep an arc from a first position in which the arm extends out over the receptacle toward a corner of the receptacle to a second position in which the arm is clear of the receptacle and the arm having a surface facing away from the receptacle so that a bottom surface of print media output to the receptacle when the arms is in the first position contacts the surface of the arm.

2. The device of claim 1, wherein the arm is pivotable on an axis located within a dimension of media output to the receptacle.

3. The device of claim 1, wherein the receptacle comprises a tray.

4. The device of claim 1, wherein the arm is pivotable back and forth between the first position and the second position.

5. The device of claim 1, wherein the receptacle is movable downward in response to print media output to the tray.

6. A print media output device, comprising:

a print media output port;

a print media output receptacle adjacent to the output port;

a motor; and a swing arm operatively coupled to the motor, the swing arm located below the output port adjacent to and above the output receptacle, the swing arm pivotable at the urging of the motor on an axis located upstream from the output receptacle within a lateral dimension of a media path that extends from the output port to the output receptacle, the swing arm, pivotable on the axis from a first position in the media path over the output receptacle, toward a corner of the output receptacle to a second position out of the media path clear of the output receptacle.

7. A system for corner registering print media in an output receptacle, comprising:

a means for establishing contact between a movable registration surface and a bottom surface of print media output to the receptacle; and a means for sweeping the registration surface through an arc.

* * * * *

UNITED STATES PATENT AND TRADEMARK OFFICE

CERTIFICATE OF CORRECTION

PATENT NO. : 7,114,717 B2
APPLICATION NO. : 10/396184
DATED : October 3, 2006
INVENTOR(S) : Peter D. Schuller et al.

It is certified that error appears in the above-identified patent and that said Letters Patent is hereby corrected as shown below:

In column 5, line 36, in Claim 1, delete “arms” and insert -- arm --, therefor.

In column 6, line 24, in Claim 6, after “swing arm” delete “,”.

Signed and Sealed this

Thirteenth Day of January, 2009

JON W. DUDAS
*Director of the United States Patent and Trademark Office*